United States Patent [19]

Gagnebin

[11] 4,291,993

[45] Sep. 29, 1981

[54] DEVICE FOR INSTALLING AND SECURING A PRINTING DISC

[75] Inventor: Gustave Gagnebin, Yverdon, Switzerland

[73] Assignee: Hermes Precisa International S.A., Yverdon, Switzerland

[21] Appl. No.: 99,721

[22] Filed: Dec. 3, 1979

[30] Foreign Application Priority Data

Dec. 20, 1978 [CH] Switzerland ..... 12926/78

[51] Int. Cl.[3] ..... B41J 1/30

[52] U.S. Cl. ..... 400/144.2; 400/175

[58] Field of Search ..... 400/144.1–144.3, 400/174, 175, 692

[56] References Cited

U.S. PATENT DOCUMENTS

| | | | |
|---|---|---|---|
| 4,124,312 | 11/1978 | Johnson | 400/144.2 |
| 4,127,335 | 11/1978 | Bogert et al. | 400/144.2 |
| 4,161,373 | 7/1979 | Chvatlinsky | 400/144.2 X |
| 4,212,552 | 7/1980 | Bemis | 400/144.2 X |

*Primary Examiner*—Paul T. Sewell

*Attorney, Agent, or Firm*—Emory L. Groff, Jr.

[57] ABSTRACT

A printing disc (1) is applied by a leaf spring (9) against a plate (6), provided with projections (14), of a support (2). These projections (14) lock the printing disc (1) in a predetermined position in the support (2). This support (2) is provided to be introduced in a typewriter transversely to the selecting shaft (15) between the driving plate (18) and the card press (16) the two folded over borders (23) of which form lateral guides. Two slots (26) of these borders (23) form abutments for bosses (25) of the support (2). The support (2) has an opening (8) opposite the hub (3), the engagement of the hub (3) of the disc (1) on the driving plate (18) is effected by pivoting the support (2) in the direction of the selecting shaft (15). The driving plate (18) passes through the opening (8) and holds the printing disc (1) spaced apart from the projections (14). This device is light and permits the mounting of the disc (1) without having to displace the selecting shaft (15).

8 Claims, 5 Drawing Figures

DEVICE FOR INSTALLING AND SECURING A PRINTING DISC

The present invention concerns a device for facilitating installing and securing a printing disc on a driving plate secured to a selecting shaft of a typewriter such as is described in the claims.

In the majority of known disc printers, the means for securing the disc at the end of the selecting shaft are, in general, of the same type as those used for securing the spherical printing heads on so-called "golf-ball" machines. The printing disc is axially engaged at the end of the selecting shaft, then secured by a spring attached to the disc being engaged in an annular groove of the selecting shaft.

This type of securing is poorly adapted to disc printers, because in order to change the printing disc, it is necessary to provide a release and sufficient access for the extension of the selecting shaft.

Driving mechanisms have already been proposed for the disc which are adapted to pivot or to swing upwardly to give easy access to the disc, so as to facilitate its installation or its replacement. These mechanisms are complex and increase the cost of the typewriter.

There have also been proposed driving mechanisms for the printing disc in which the selecting shaft is adapted to be displaced axially. The disc, disposed in a casing, is slid in a journal opposite the selecting shaft, then by axial displacement of the selecting shaft, to the end of this shaft crosses a slot of the casing and comes to co-operate with the hub of the printing disc.

These mechanisms are still costly to manufacture, since the angular play in the selecting shaft must be as little as possible and it is necessary to assemble these carefully. Moreover, these mechanisms are carried by the carriage of the typewriter and increase its weight, whilst it is sought to make a carriage of minimum weight.

The object of the invention is to facilitate the installation of the printing disc without any intervention into the driving mechanism being necessary.

According to the present invention there is provided a device for installing and securing a printing disc on a driving plate secured to a selecting shaft of a typewriter, the typewriter driving plate having angular locating means adapted to co-operate with the hub of the printing disc, comprising a support for the printing disc members on the support for retaining the disc in a single relative position, and guide and abutment means for defining an engagement position of the support in the typewriter in which the hub of the printing disc is substantially opposite the driving plate, the printing disc being adapted to co-operate with the driving plate after a displacement of the support in the direction of the selecting shaft.

The present invention will be described further, by way of example, with reference to the accompanying drawings, in which.

Figure 1:
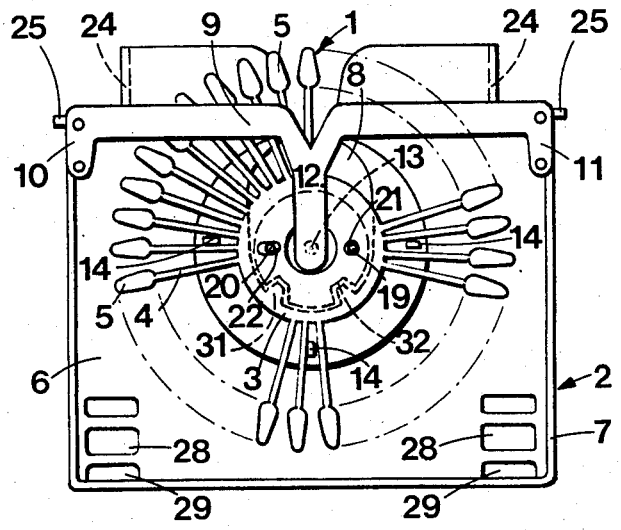
FIG. 1 is a partial view in elevation of the device according to the present invention.

With reference to FIG. 1, a printing disc 1 is housed in a support 2. The printing disc 1 is constituted by a hub 3 carrying radial arms 4 the ends of which are provided with relief characters 5. The support 2 is constituted by a plate 6, three sides of which are provided with a border 7, and which has an opening 8 in its central region. A leaf spring 9, of generally T shape, is fixed on the support 2, the ends of the two branches 10 and 11 of the leaf spring 9 being riveted on the borders 7, whilst the central part 12 of the leaf spring 9 extends towards the central region of the support 2.

The printing disc 1 is biased against the plate 6 by the leaf spring 9 and projections 14 of this plate 6 are engaged between radial arms 4 of the printing disc 1; these projections 14 fix the position of the disc 1 with respect to the support 2.

Figure 3:
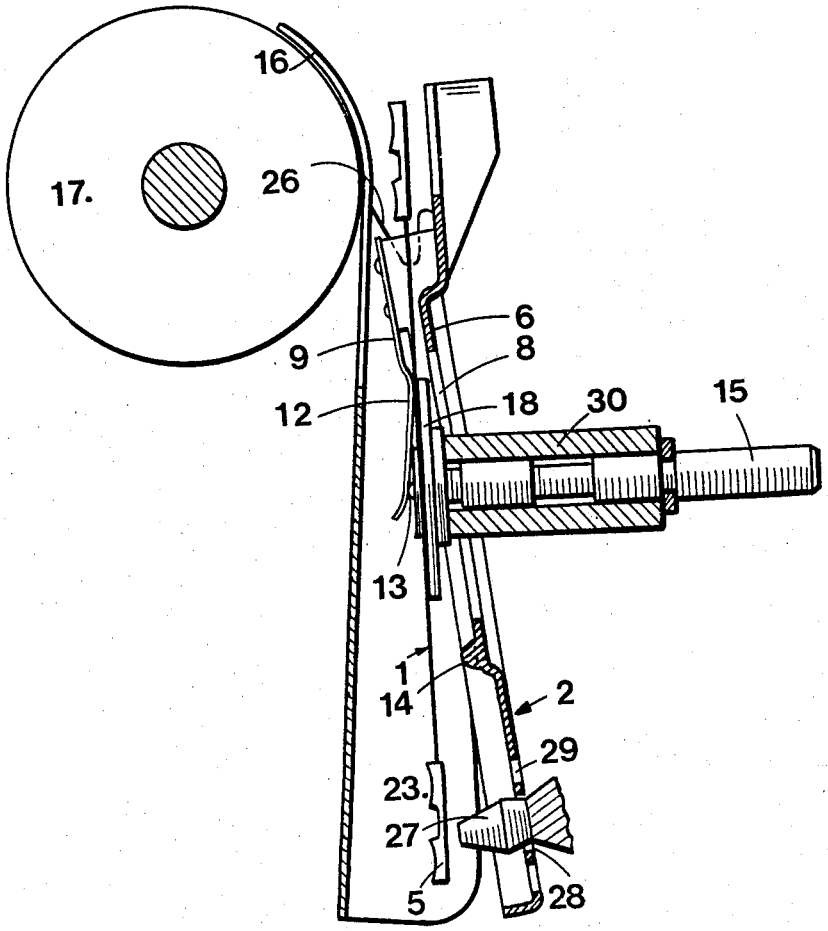
FIG. 3 is a side view on an enlarged scale of the device, the disc being coupled at the end of the selecting shaft.

So as to ensure a quasi-point contact of the leaf spring 9 on the disc 1, the hub 3 is provided with a spherical abutment 13, visible in FIG. 3.

Figure 2:
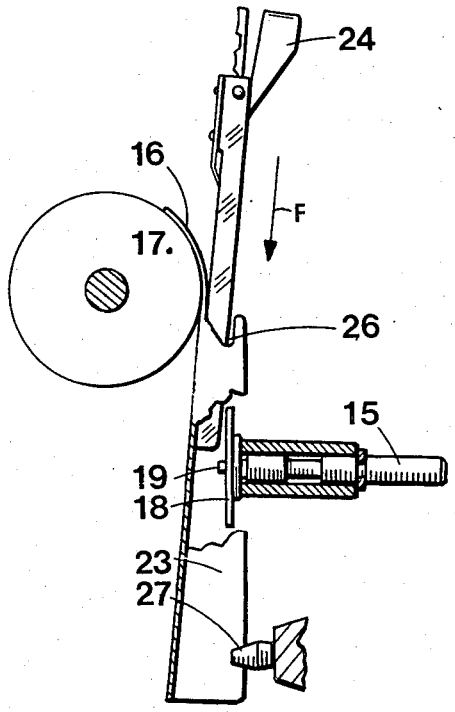
FIG. 2 is a side view of the device during the installation of the disc.

FIG. 2 illustrates the installation of a printing disc 1 in a typewriter. The typewriter has a carriage, not shown, carrying a selecting shaft 15 and a card press 16, this carriage being adapted to be displaced parallel to the axis of a platen 17.

The end of the selecting shaft 15 is provided with a driving plate 18, two projecting fingers 19 and 20 of which are adapted to be respectively engaged in a bore 21 and a radial slot 22 of the hub 3 of the disc 1. So as to obtain good precision during the manufacture of the disc 1, the bore 21 and the radial slot 22 serve as references for its machining and for the setting of the printing characters 5 at the ends of the radial arms 4.

The card press 16 extends downwardly with respect to the driving plate 18 and has two borders 23 folded at right angles forming lateral guides for the support 2. The support 2 has two gripping flanges 24 permitting the user to hold it between the thumb and the index finger to insert it, as illustrated in FIG. 2, between the card press 16 and the coupling plate 18, transversely to the axis of the selecting shaft 15.

The support 2 is slid in the direction of the arrow F until the bosses 25, provided on each side of the support 2, come into engagement with the slots 26 cut out of the upper part of the borders 23 of the card press 16.

When the bosses 25 are in abutment with the slots 26, the center of the printing disc 1 is substantially aligned with the axis of the selecting shaft 15. The engagement of the printing disc 1 in the support 2 onto the driving plate 18 is effected by pivoting the support 2 backwardly, in the direction of the selecting shaft 15.

As shown in FIG. 2, the carriage carries hooking members 27 adapted to be engaged in holes 28 of the plate 6 in the manner of press buttons. The holes 28 have slots 29 on two opposed sides to give a sufficient elasticity in the sides of the said holes 28 for the passage of the hooking members 27.

FIG. 3 shows the setting and fixing device after the engagement of the disc 1 on the driving plate 18. During this engagement, the support 2 pivots around an axis passing substantially through the two bosses 25. The driving plate 18 passes through the opening 8 of the plate 6 of the support 2, and the disc 1, under the action of the leaf spring 9, bears against this plate 18. The fingers 19 and 20 engage in the bore 21 and the slot 22 of the hub 3. Upon further pivotal movement of the support 2, the projections 14 become disengaged from the radial arms 4, then the hooking members 27 engage in the holes 28, thereby retaining the support 2.

The device described above permits the installation or the replacement of a printing disc without interfering, especially by rocking or displacing, with the control mechanism of the disc and more especially on the selecting shaft 15.

The printing disc 1 illustrated has two concentric rows of characters 5. The shift movement is ensured by a vertical displacement of the selecting shaft 15, this latter being guided in a bearing 30 secured at the end of a lever oscillatingly mounted on the carriage. To permit the vertical displacement of the selecting shaft 15, the opening 8 of the support 2 is extended, as is shown in FIG. 1. Moreover, the lower edge of this opening 8 has two feet 31 corresponding to two slots 32 in the driving plate 18. This is provided to avoid errors during the insertion of the printing disc 1, the plate 18 only being able to cross the opening 8 of the support 2 in one relative angular position.

Figure 4:
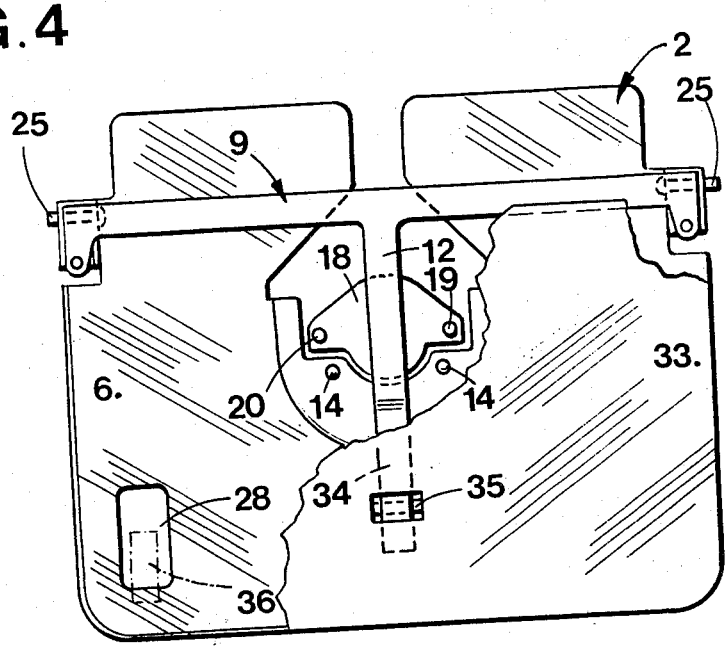
FIG. 4 is a partial view in elevation of a variation of the device.

FIG. 4 shows an alternative support 2 from which the printing disc has been removed. This support 2 is of sheet metal and is provided with a cover 33 pivoting on the two support bosses 25. The central part 12 of the leaf spring 9 has an extension 34 slidingly mounted in a slot 35 of the cover 33. This cover 33 ensures a suitable protection for the disc 1 during handling of the support 2 and during loading.

During the insertion of the disc 1, the cover 33 pivots with respect to the plate 6 of the support and is maintained spaced away from the disc 1 by the extension 34 of the central part 12 of the leaf spring 9.

Means could be provided for bolting the cover 33 against the support 2 when this latter is not mounted in a typewriter. As shown in FIG. 4, there could be provided projections 14 of the plate 6 situated opposite the hub 3 of the disc 1 and co-operating with an oblong hole and a bore of this hub 3 to fix the angular position of the disc 1 with respect to the support 2.

Figure 5:
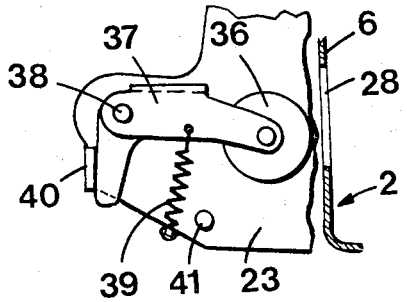
FIG. 5 is a side view of a detail of this variation.

As shown in FIG. 5, the hooking means of the support 2 may be constituted by rollers 36 adapted to pass through the holes 28 of the plate 6 and co-operate with the lower borders of these holes 28 to retain the support 2. Each roller 36 is mounted at one end of a lever 37 engaged on a pivot 38 secured to one of the borders 23 of the card press 16. Each lever 37 is biased towards the bottom of the card press 16 by a spring 39 and bears against a fold 40 forming a stop. When the support 2 is pivoted, to ensure the engagement of the disc 1, the rollers 36 pass through the holes 28 pivoting the levers 37 against the action of the spring 39, then retain the support 2 spaced apart from the disc 1. Two fingers 41, secured on the two borders 23 of the card press 16, form abutments adapted to co-operate with the support 2.

The hooking members could also each be constituted by a sheet of spring steel folded in a manner so that they have a resilient transverse section adapted to be elastically pinched until they co-operate with the holes 28 of the plate 6.

In the device described, the pivoting of the support for the engagement of the disc is ensured by holding the gripping feet 24 and then pushing in the direction of the platen 17. One could, of course, conceive means operating on the lower part of the support 2 to control the engagement of the disc 1. These means could be, for example, constituted by a lever, one end of which in the form of a fork, co-operates with the support 2 whilst the other end is submitted to the action of a spring. For the insertion of the disc 1, this lever is pivoted against the action of the spring and maintained in position by a cog, the fork being found in this position in the transverse trajectory of the support 2. In this variation, the transfer of the disc is controlled by releasing the lever. This lever could, of course, be operated by an electro-magnet.

I claim:

1. A device for installing and securing a printing disc having radial arms on a driving plate secured to a selecting shaft of a typewriter having a carriage with a card press with folded over borders, the driving plate having angular locating means adapted to cooperate with the hub of the printing disc; comprising a support for the printing disc, retaining members in the form of projections on the support adapted to extend between the radial arms for retaining the disc in a single relative position, and guide and abutment means for defining an engagement position of the support in the typewriter in which the hub of the printing disc is substantially opposite the driving plate, the printing disc being adapted to cooperate with the driving plate after a displacement of the support in the direction of the selecting shaft, said support having an elastic member biasing the disc against the retaining members, the disc being spaced apart from the retaining members when it is engaged on the driving plate, the support being constituted by a support plate having projections forming said retaining members and a central opening opposite the hub of said disc, said guiding and abutment means being constituted by slots in the upper ends of the folded over borders of said card press, these borders forming two lateral guides for the support and each slot forming an abutment, bosses secured to said support engageable with said abutments, the support being adapted to be introduced transversely to the selecting shaft between the two borders, then pivoted in the direction of the selecting shaft around an axis passing through the two bosses.

2. A device in accordance with claim 1, in which the elastic member is constituted by a leaf spring in the general form of a T, the two arms of which are fixed to the support, whilst the central part biases the printing disc against the plate, this leaf spring being adapted to place the printing disc against the driving plate and to form an axial abutment when the printing disc is coupled to the selecting shaft.

3. A device in accordance with claim 2, in which the hub of the disc has a spherical abutment against which the leaf spring bears.

4. A device in accordance with claim 3 including, hooking means for holding the support in a position spaced away from the printing disc after the engagement of said printing disc on the driving plate, said hooking means comprising a projection on the typewriter carriage having a portion engageable in an opening in the support.

5. A device in accordance with claim 4 in which, the driving plate has spaced recesses therein and said support plate has spaced feet adapted to engage said recesses in a manner to define a singular angular position of the driving plate with respect to the support for the engagement of the printing disc, this position being defined before the disc enters into contact with the plate.

6. A device in accordance with claim 5 in which, the printing disc comprises two concentric rows of characters adapted to be shifted by a translation of the selecting shaft, the opening of the support plate being extended in a direction perpendicular to the pivotal axis of the shaft and containing said feet, the central part of the leaf spring extending perpendicular to this axis, opposite the opening.

7. A device in accordance with claim 6, including a cover pivotally mounted on the support on an axis parallel to the pivotal axis of the support, the leaf spring having an extension of its central part sliding in a slot of the cover.

8. A device in accordance with claim 5 in which, the hub of the printing disc has a bore and a diametrically opposed radial slot and the driving plate has two fingers adapted to cooperate with said bore and radial slot serving, during the manufacture of the printing disc, as references for its machining and for the mounting of characters at the ends of the radial arms.

* * * * *